US006822581B2

(12) United States Patent
Chaffe

(10) Patent No.: US 6,822,581 B2
(45) Date of Patent: Nov. 23, 2004

(54) TRAFFIC SIGNAL WITH ADJUSTABLE CYCLES

(76) Inventor: Marian Chaffe, 4 Wilson St., Spencer, MA (US) 01562

( * ) Notice: Subject to any disclaimer, the term of this patent is extended or adjusted under 35 U.S.C. 154(b) by 43 days.

(21) Appl. No.: 10/272,202

(22) Filed: Oct. 16, 2002

(65) Prior Publication Data

US 2004/0075583 A1 Apr. 22, 2004

(51) Int. Cl.[7] ..... G08G 1/095; G08G 1/00

(52) U.S. Cl. ..... 340/907; 340/309.3; 340/309.4; 340/309.8; 340/925; 368/89; 368/223; 368/243

(58) Field of Search ..... 340/309.3, 309.4, 340/309.8, 925, 944; 368/1, 89, 223, 243

(56) References Cited

U.S. PATENT DOCUMENTS 3,594,720 A * 7/1971 Cane ..... 340/925
4,025,922 A * 5/1977 Trawick, III ..... 342/24
5,406,276 A * 4/1995 Ogle ..... 340/944
6,268,805 B1 7/2001 Simon ..... 340/907
6,384,742 B1 * 5/2002 Harrison ..... 340/944
2002/0062207 A1 * 5/2002 Faghri ..... 703/8

* cited by examiner

*Primary Examiner*—Jeffery Hofsass
*Assistant Examiner*—Samuel J. Walk
(74) *Attorney, Agent, or Firm*—Fish & Richardson P.C.

(57) ABSTRACT

A traffic signal includes a micro-controller in communication with a switching system. The micro-controller executes a process for controlling a signal indicator according to a selected signal cycle. First and second actuators communicate with the corresponding first and second input terminals of the micro-controller. The first actuator causes the micro-controller to execute a first signal cycle. The second actuator causes the micro-controller to execute a second signal cycle.

20 Claims, 4 Drawing Sheets

TRAFFIC SIGNAL WITH ADJUSTABLE CYCLES

FIELD OF INVENTION

This invention relates to traffic signals, and in particular, to traffic signals controlled by a micro-controller.

BACKGROUND

A pedestrian who wants to cross a street is indeed fortunate to encounter a traffic signal. By pressing a button, usually mounted on a post near the traffic signal, the pedestrian can initiate a pedestrian cycle. During the pedestrian cycle, the traffic signal halts all vehicular traffic for enough time to allow the pedestrian to cross the street.

A conventional traffic signal does not know how much time the pedestrian will require to cross the street. As a result, the time allotted for a pedestrian to cross the street is set to the an average crossing time. However, the pedestrian may be unable to cross the street within the allotted time. For example, the pedestrian may be elderly, handicapped, burdened by luggage, pregnant, or coping with small children. A conventional traffic signal can maroon such pedestrians in the middle of the street, facing a wall of cars inching forward in anticipation of a green light.

SUMMARY

A traffic signal according to the invention provides two or more pedestrian-selectable cycles. A pedestrian who uses such a traffic signal can thus select a pedestrian cycle that will provide sufficient time to cross the street.

In one aspect, the traffic signal includes a micro-controller in communication with a switching system. The micro-controller executes a process that controls a signal indicator according to a selected signal cycle. First and second actuators communicate with corresponding first and second terminals of the micro-controller. The first actuator causes the micro-controller to execute a first signal cycle. The second actuator causes the micro-controller to execute a second signal cycle.

The second actuator can be directly connected to the micro-controller. Alternatively, the second actuator can be in wireless communication with the micro-controller. For example, the traffic signal can include a wireless receiver in communication with the micro-controller. A transmitter can then be used to signal the receiver to cause a signal to be sent to an appropriate input terminal of the micro-controller. Examples of wireless receivers include frequency receivers, ultrasonic receivers, optical receivers, microwave receivers, and infrared receivers.

The micro-controller is typically configured to execute a selected pedestrian cycle in response to a signal from one of the first and second actuators. The pedestrian cycle is selected on the basis of which of the first and second actuators provides the signal.

The pedestrian cycles selected by each of the first and second actuators can differ in many ways. However, in one embodiment, the pedestrian cycles have different wait intervals, different walk intervals, different sprint intervals, or any combination thereof.

In another aspect, the invention provides a method for controlling a traffic signal by controlling the traffic signal in accord with a first cycle and detecting an interrupt signal on one of a plurality of input terminals. In response to detecting such an interrupt signal, the first cycle is interrupted and a selected second cycle is executed in place of the first cycle. The second cycle is selected on the basis of which of the input terminals carried the interrupt signal.

A traffic signal according to the invention thus enables a pedestrian to select between two or more pedestrian cycles. This feature can readily be incorporated into existing traffic signals, many of which are already operated by a micro-controller having an unused second input terminal. In such a case, the traffic signal can be retrofitted by reprogramming the micro-controller. In other cases, the micro-controller is simply replaced by one having at least two input terminals.

These and other features of the invention will be apparent from the following detailed description and the accompanying drawings, in which:

DETAILED DESCRIPTION

Figure 1:
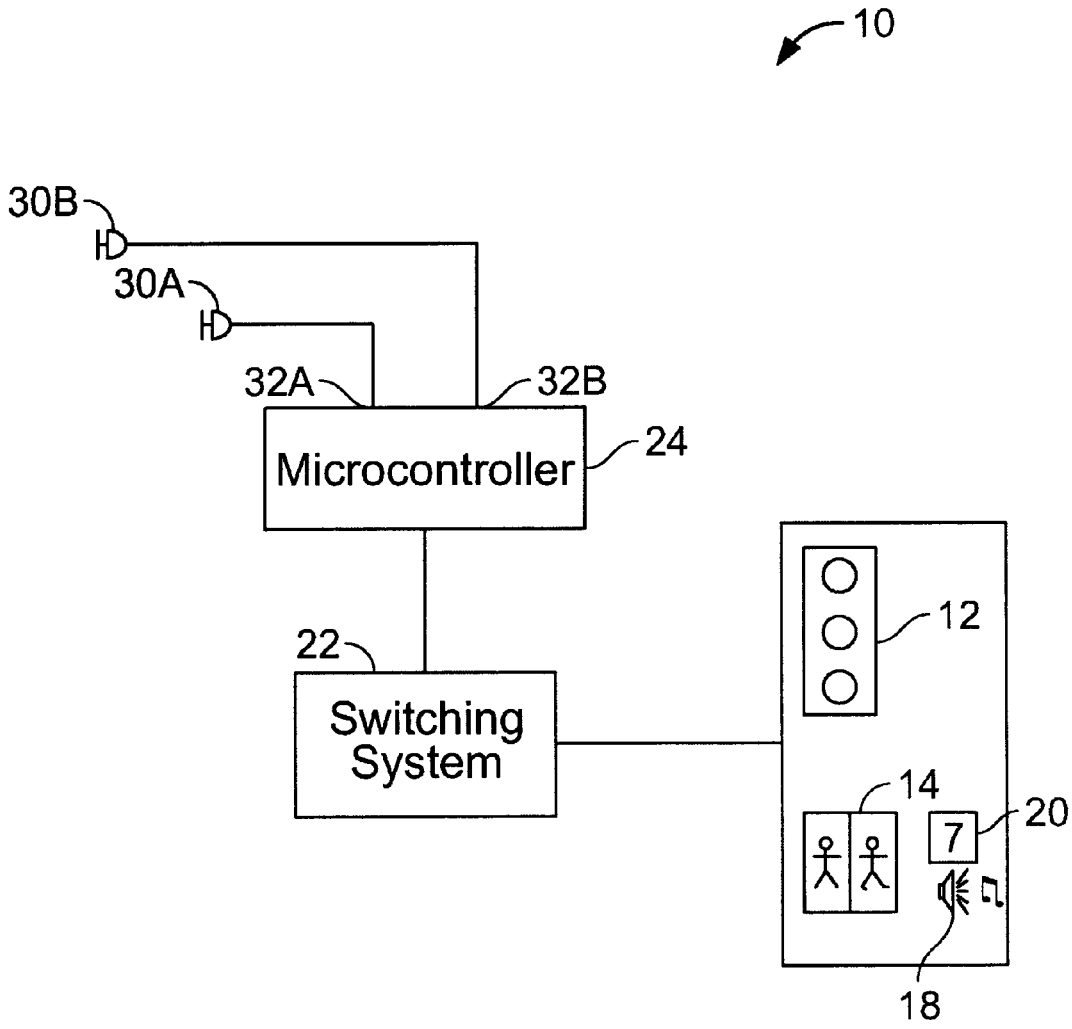
FIG. 1 is a schematic of a control unit for operating a traffic signal according to the invention.

Referring to FIG. 1, a traffic signal 10 includes several vehicular signals 12 and several pedestrian signals 14. Each vehicular signal 12 is typically an assembly of one or more lamps filtered by red, green or yellow lenses and sometimes masked by a stencil showing an arrow pointing in an appropriate direction. Each pedestrian signal 14 is typically a pair of lamps masked by a stencil showing a stationary or walking person, an outstretched palm, or by words such as "WALK" and "DON'T WALK." In a growing number of installations, the pedestrian signal 14 also includes a speaker 18 that emits an audible signal. In other installations, either or both the pedestrian signal 14 and the vehicular signal 12 includes a count-down timer 20 showing how much time is remaining before the signal changes state.

The various signal elements of both the vehicular signal 12 and the pedestrian signal 14 are turned on and off by a switching system 22 coupled to each such element. Because the lamps to be turned on and off operate at line voltage, the switching system 22 is typically a set of electromagnetic relays. However, for LED traffic signals, the switching system 22 can be a set of low voltage semiconductor switches.

A micro-controller 24 in communication with the switching system 22 constantly executes a control program that causes signal elements to be turned on and off according to a pre-defined control sequence. The control sequence can be quite simple. For example, at many rural intersections, the vehicular signal 12 is nothing more than a flashing red light. Other control sequences, such as those controlling urban interchanges, can include red, yellow, and green indicator lights pointing in various directions. An exemplary control system for controlling a four-way intersection is shown in FIG. 2.

Figure 2:
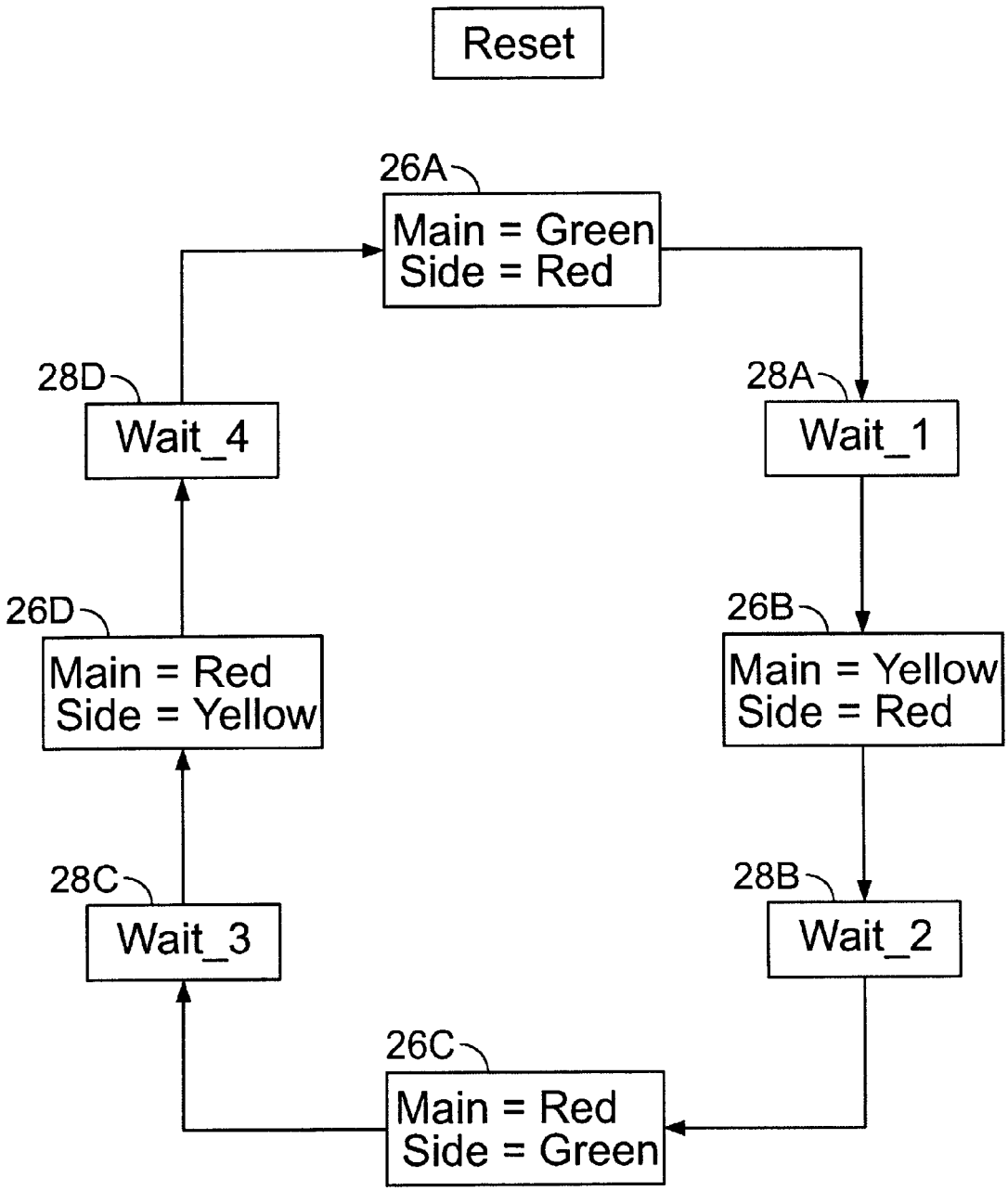
FIG. 2 is a flow-chart for a vehicular cycle executed by the micro-controller of FIG. 1.

Referring now to FIG. 2, a vehicular cycle executed by the control program has four possible states 26A–D. Each state corresponds to a particular combination of lit lamps. The vehicular cycle also includes four waiting times 28A–D that temporally separate the states from each other. These waiting times are selected to accommodate expected flow of vehicular traffic. In some cases, the vehicular cycle can have states and waiting times in addition to those shown in FIG. 2. For example, to avoid collisions caused by scofflaws, there may be a pair of states in which traffic in all directions is momentarily halted before traffic in one direction is allowed to proceed.

A pedestrian who wishes to cross the intersection presses an actuator button 30A–B, shown in FIG. 1, that causes an interrupt signal at one of a plurality of micro-controller input terminals 32A–B. This causes the micro-controller 24 to temporarily stop executing the vehicular cycle and to instead execute the pedestrian cycle shown in FIG. 3.

Figure 3:
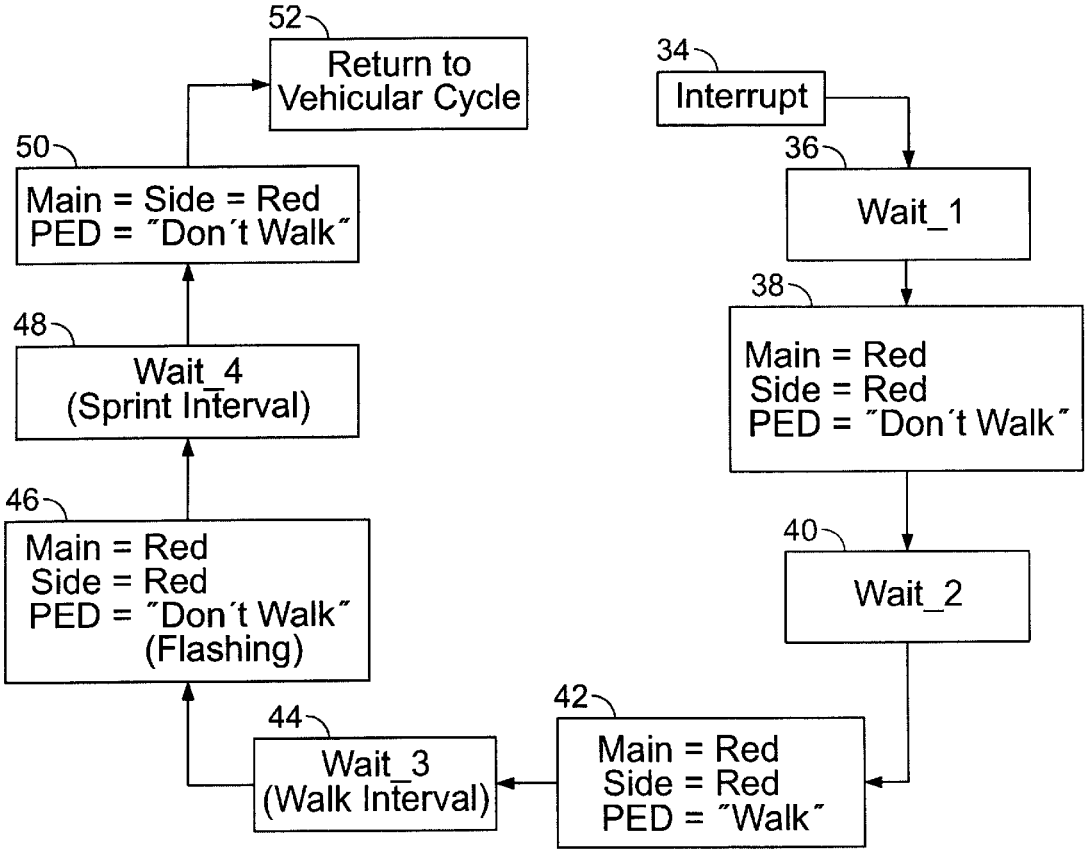
FIG. 3 is a flow-chart of a pedestrian cycle executed by the micro-controller of FIG. 1.

Referring now to FIG. 3, the pedestrian cycle, like the vehicular cycle, has several states separated by different waiting times. When the pedestrian presses the interrupt button (step 34), the micro-controller 24 waits for a first interval (step 36) before entering a first state in which both vehicular signals are red and the pedestrian signal is set to "DON'T WALK" (step 38). The micro-controller 24 then waits for a second interval (step 40) before entering a second state in which both vehicular signals are red and the pedestrian signal is set to "WALK" (step 42). The micro-controller 24 then waits for a third interval, referred to herein as the "walk interval" (step 44). After the lapse of the walk interval, the micro-controller 24 enters a third state in which the vehicular signals continue to be red but the pedestrian signal shows a flashing "DON'T WALK " (step 46). The micro-controller 24 remains in this state during a fourth interval, referred to herein as the "sprint interval" (step 48). Once the sprint interval elapses, the micro-controller 24 enters a fourth state in which the vehicular signals are red and the pedestrian signal is set to "DON'T WALK" (step 50) and resumes execution of the vehicular cycle (step 52).

The lengths of both the sprint interval and the walk interval depend on the average time required to cross the street. However, there are an appreciable number of pedestrians who, as a result of a physical handicap, take considerably longer to cross the street. To reduce the likelihood that these pedestrians are stranded in the middle of the street when the pedestrian cycle re-enters the vehicular cycle, the micro-controller 24 is configured to allow a pedestrian to select from two or more pedestrian cycles, each having different walk intervals and sprint intervals.

As discussed in connection with FIG. 1, the micro-controller 24 has more than one input terminal 32A–B for receiving an interrupt signal. Each input terminal 32A–B is connected to an actuator button 30A–B, typically mounted on a pole at the intersection. A pedestrian who presses an actuator button 30A–B initiates a pedestrian cycle in which the waiting times between states depends on the particular actuator button 30A–B pressed. In this way, the pedestrian who expects to walk briskly across the street can press a first actuator button 30A that initiates a pedestrian cycle with a shorter walk interval and a shorter sprint interval. A pedestrian who expects to take somewhat longer to cross the street can press a second actuator button 30B that initiates a pedestrian cycle having extended walk and sprint intervals.

In the embodiment shown in FIG. 1, two actuator buttons 30A–B connect to corresponding first and second input terminals 32A–B of the micro-controller 24. Both actuator buttons 30A–B are mounted on a post at the intersection and labeled to enable a pedestrian to press the correct actuator button 30A–B.

Figure 4:
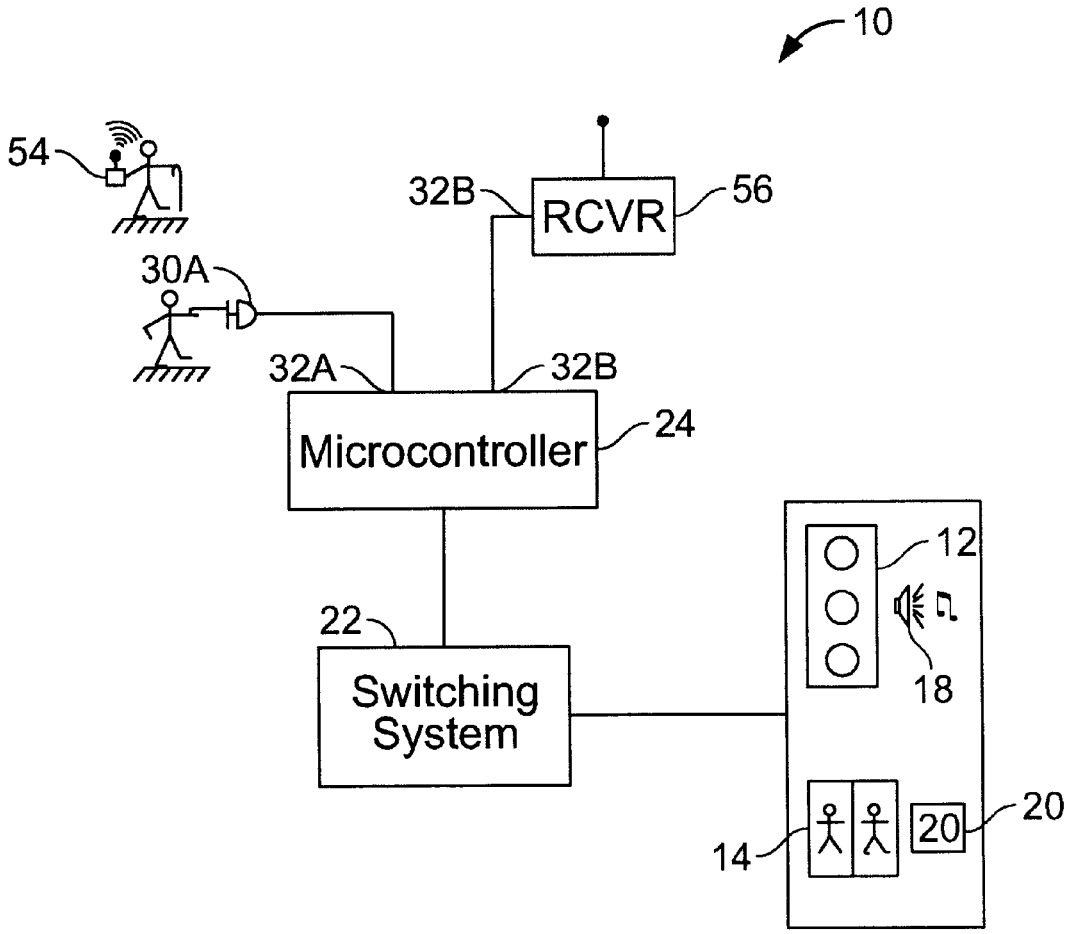
FIG. 4 is a schematic of a control unit with a wireless receiver.

In another embodiment, shown in FIG. 4, the second actuator button 30B is connected to a portable wireless transmitter 54 carried by the pedestrian. In this case, the second input 32B of the micro-controller 24 is connected to a wireless receiver 56 configured to present a signal to the second input terminal 32B upon receipt of a signal from the transmitter 54. The wireless transmitter 54 can be an infrared transmitter, in which case the pedestrian must point the infrared beam at an infrared detector in communication with the receiver. Or, the wireless transmitter 54 can be a radio frequency transmitter, in which case a radio frequency is selected to avoid interference with other radio transmissions in the vicinity. Other transmitters include ultrasonic transmitters, optical transmitters, and microwave transmitters.

In either case, the signal provided by the wireless transmitter 54 can be modulated to reduce the possibility that stray radiation will initiate an unnecessary pedestrian cycle. In such a case, the receiver 56 includes a processor for determining whether the incoming wireless signal is correctly modulated.

The control program processes the interrupt signal in one of two ways. In one practice of the invention, the control program transfers control from the vehicular cycle to the pedestrian cycle as soon as possible. In another practice of the invention, the control program sets an interrupt variable in response to receiving the interrupt signal. Then, at a pre-selected time during each execution of the vehicular cycle, the control program checks the interrupt variable. If the interrupt variable is set, the control program transfers control from the vehicular cycle to the pedestrian cycle. Otherwise, the control program continues with execution of the vehicular cycle.

Suitable micro-controllers include those made by Atmel Corporation of San Jose, Calif. and by Microchip Corporation of Chandler, Ariz. Appendix A shows source code in "C" to be executed on an ATMEL™ micro-controller to cause that micro-controller to execute a selected pedestrian cycle on the basis of which micro-controller input terminal 32A–B receives an interrupt signal.

As described herein, the micro-controller 24 has two input terminals 32A–B for selecting between two different pedestrian cycles. However, the micro-controller 24 can include more than two input terminals. In such a case, additional actuators can be provided for those input terminals. The micro-controller 24 can then be configured to select between more than two pedestrian cycles.

The different pedestrian cycles need not differ only according to their walk intervals. For example, an additional actuator may be provided to cause the micro-controller to execute a pedestrian cycle that operates the speaker. In such a case, the micro-controller causes the speaker to produce a sound that corresponds to a state in the pedestrian cycle.

It is to be understood that while the invention has been described in conjunction with the detailed description thereof, the foregoing description is intended to illustrate and not limit the scope of the invention, which is defined by the scope of the appended claims.

COMPUTER PROGRAM LISTING

```
/*
Defines and inline functions that are useful when writing C
programs for the 4433. Made for the uC on the 2002 robot.
Currently has functions for: enabling/disabling interrupts,
using the external interrupts, using timer0, causing small
delays.
```

-continued

COMPUTER PROGRAM LISTING

```
*/
#ifndef __HELPER__ H__
#define __HELPER__ H__
#include <io.h>
#include <interrupt.h>
#include <sig-avr.h>
#include <timer.h>
#ifndef __AVR__AT90S4433__
#error This header file is for the 4433 series only.
#endif
/*
    Master interrupt enable and disable.
    Interrupt requests will be queued while interrupts
    are disabled and handled after interrupts are
    re-enabled, in order of priority.
*/
#define enable__interrupts( )    __asm__ __volatile__ ("sei" ::)
#define disable__interrupts( )    __asm__ __volatile__ ("cli" ::)
/*
    External interrupts.
    These functions let you enable/disable the external
    interrupts and select what events will trigger them.
*/
typedef enum {LOW=0, BOTH, FALLING, RISING} EXT__INT__
TYPES;
inline void int0__set__type(EXT__INT__TYPES typ)
{    outp(((inp(MCUCR) & 0xFC) | typ), MCUCR);    }
inline void int1__set__type(EXT__INT__TYPES typ)
{    outp(((inp(MCUCR) & 0xF3) | (typ<<2)),MCUCR);    }
inline void int0__enable(void)
{    sbi(GIMSK, INT0);    }
inline void int1__enable(void)
{    sbi(GIMSK, INT1);    }
inline void int0__disable(void)
{    cbi(GIMSK, INT0);    }
inline void int1__disable(void)
{    cbi(GIMSK, INT1);    }
/*
    Timer0:    This is the chip's simple 8-bit counter.
*/
/*
    in timer.h:
static inline void timer0__source (unsigned int src);
    Choose the timer's input:
        STOP, CK, CK8 (system clock/8), CK64, CK256,
    CK1024, T0__FALLING__EDGE, or T0__RISING__EDGE (on
    external
      pin).
*/
inline uint8__t timer0__read(void)
{    return inp(TCNT0); }
inline void timer0__set(uint8__t val)
{    outp(val, TCNT0); }
inline void timer0__enable__interrupt(void)
{    sbi(TIMSK, 1); }
inline void timer0__disable__interrupt(void)
{    cbi(TIMSK, 1); }
/*
ADC:    These functions let us read from the analog inputs.
  Note that an interrupt handler is required to know when the
  inputted data is ready to be read.
*/
inline void adc__enable(void)
{
    sbi(ADCSR, 2);    /* Sets the ADC clock the clk/64. When clock
is 8 mHz, this*/
    sbi(ADCSR, 1);    /* yields an ADC clock of 125 kHz, the fastest
available */
    cbi(ADCSR, 0);    /* speed within the ADCs tolerable range. (50
to 200 kHz) */
    sbi(ADCSR, 7);    /* enables the ADC */
}
inline void adc__enable__interrupt(void)
{    sbi(ADCSR, 3);    }
inline void adc__disable__interrupt(void)
{    cbi(ADCSR, 3);    }
inline void adc__select__input (uint8__t num)
{    outp(num & 0x07, ADMUX);    }
inline void adc__start__conversion(void)
{    sbi(ADCSR, 6);    }
inline uint16__t adc__get__value10(void)
{
    uint16__t v = 0;
    v = inp(ADCL);
    v |= (inp(ADCH) << 8);
    return (v);
}
inline uint8__t adc__get__value8(void)
{    return (adc__get__value10( ) >> 2);    }
/*
    Delays:    These functions are useful for causing
               small delays.
*/
/* nop takes exactly one cycle to execute. */
#define nop( )    __asm__ __volatile__ ("nop" ::);
#endif
//#define    __AVR__AT90S4433__
#include <io.h>
#include <interrupt.h>
#include <sig-avr.h>
#include "helper.h"
/*** enumerated types ***/
enum { /* walk lights */
    WALK = 64,
    DONT__WALK = 128
};
enum { /* traffic lights */
    MAIN__GREEN = 1,
    MAIN__YELLOW = 2,
    MAIN__RED = 4,
    SIDE__GREEN = 8,
    SIDE__YELLOW = 16,
    SIDE__RED = 32
};
/***    global variables    ***/
volatile int8__t walk__pressed = 0;    /* walk button pressed
sometime */
volatile int8__t walk__signal__pressed = 0;    /* walk transmitter
pressed */
volatile int16__t cycle__timer = 0;    /* clock divider for large
values */
/*** function prototypes ***/
void wait__time(float seconds, float min__seconds);
void set__walk__signals(int8__t walk__lights);
void set__traffic__signals(int8__t traffic__lights);
void main__sequence(void);
void side__sequence(void);
void walk__sequence(void);
/*** interrupt service routine ***/
/*
 *    Handler for INT0, the extenal interrupt on pin INT0.
 *    This pin is connected to the normal walk button.
 *    We are simply setting the global variable to indicate that
 *    the walk button was pressed.
 */
SIGNAL (SIG__INTERRUPT0) {
    walk__pressed = 1;
}
/*
 *    Handler for INT1, the extenal interrupt on pin INT1.
 *
 *    This pin is connected to the transmitted walk signal.
 *
 *    We are simply setting the global variable to indicate
 *    that the walk button was pressed.
 */
SIGNAL (SIG__INTERRUPT1) {
    walk__signal__pressed = 1;
}
/*
 *    Handler for timer0. This interrupt is triggered when
 *    timer0 overflows.
 *
 *    We are incrementing the signal timer so that the
```

-continued

COMPUTER PROGRAM LISTING

```
 *    sequence loops will know how much time has elapsed.
 */
SIGNAL (SIG_OVERFLOW0) {
      cycle_timer++;
      timer0_set(1); /* set to overflow after 255 ticks */
      /* 8 MHz, timer set to clk/1024, 255 ticks is 30.637255 Hz,
0.03264 s */
}
/*
 *    Pause for a given number of seconds.
 */
void wait_time(float seconds, float min_seconds) {
      int16_t ticks = seconds * 30.637255;
      int16_t min_ticks = min_seconds * 30.637255;
      cycle_timer = 0;
      while (cycle_timer < min_ticks)
            ;
      while (cycle_timer < ticks)
            if (walk_pressed || walk_signal_pressed)
                  break;
}
/*
 *    Turn the walk lights on or flash them off.
 */
void set_walk_signals(int8_t walk_lights) {
      outp(walk_lights, PORTD);
}
/*
 *    Turn the traffic lights on or off.
 */
void set_traffic_signals(int8_t traffic_lights) {
      outp(traffic_lights, PORTC);
}
/*
 *    Sequence to control traffic on main street
 */
void main_sequence(void) {
      set_traffic_signals(MAIN_GREEN | SIDE_RED);
      wait_time(20.0, 5.0);
      set_traffic_signals(MAIN_YELLOW | SIDE_RED);
      wait_time(2.0, 2.0);
      set_traffic_signals(MAIN_RED | SIDE_RED);
      wait_time(1.0, 1.0);
}
/*
 *      Sequence to control traffic on side street
 */
void side_sequence(void) {
      set_traffic_signals(MAIN_RED | SIDE_GREEN);
      wait_time(10.0, 5.0);
      set_traffic_signals(MAIN_RED | SIDE_YELLOW);
      wait_time(1.0, 1.0);
      set_traffic_signals(MAIN_RED | SIDE_RED);
      wait_time(1.0, 1.0);
}
/*
 *    Sequence to control the pedestrian lights
 */
void walk_sequence(void) {
      int8_t i;
      set_walk_signals(WALK);
      if (walk_signal_pressed)
            wait_time(16.0, 16.0);
      else
            wait_time(8.0, 8.0);
      set_walk_signals(DONT_WALK);
      for (i = 0; i < 5; i++) {
            wait_time(0.5, 0.5);
            set_walk_signals(0);
            wait_time(0.5, 0.5);
            set_walk_signals(DONT_WALK);
      }
      wait_time(2.0, 2.0);
      walk_pressed = walk_signal_pressed = 0;
}
int main(void) {
      /* set ports to inputs or outputs */
```

-continued

COMPUTER PROGRAM LISTING

```
      outp(0x00, DDRB);        /* Port B is unused, set as inputs */
      outp(0xff, DDRC);        /* Port C is traffic light outputs */
      outp(0xc0, DDRD);        /* Port D is walk light outputs */
      outp(0, PORTC);        /* Turns off all traffic lights */
      outp(0, PORTD);        /* Turns off all walk lights */
      set_walk_signals(DONT_WALK);
      /* set up the timer */
      timer0_source(CK1024);
      timer0_enable_interrupt( );
      /* set up the external interrupts */
      int0_set_type(RISING);
      int0_enable( );
      int1_set_type(RISING);
      int1_enable( );
      enable_interrupts( );
      /* Process the traffic light sequence */
      while (1) {
            main_sequence( );
            if (walk_pressed || walk_signal_pressed)
                  walk_sequence( );
            side_sequence( );
            if (walk_pressed || walk_signal_pressed)
                  walk_sequence( );
      }
}
```

I claim:

1. A traffic signal comprising:

a micro-controller in communication with a switching system for executing a process to control a signal indicator according to a selected signal cycle, the micro-controller having first and second input terminals;

a first actuator in communication with the first input terminal for causing the micro-controller to execute a first signal cycle; and a second actuator in communication with the second input terminal for causing the micro-controller to execute a second signal cycle that differs from the first signal cycle.

2. The traffic signal of claim 1, wherein the second actuator comprises a wireless receiver in communication with the micro-controller.

3. The traffic signal of claim 2, wherein the wireless receiver comprises a receiver selected from the group consisting of a radio frequency receiver, an ultrasonic receiver, an optical receiver, a microwave receiver, and an infrared receiver.

4. The traffic signal of claim 2, further comprising a wireless transmitter for communication with the wireless receiver.

5. The traffic signal of claim 1, wherein the micro-controller is configured to interrupt a vehicular cycle to initiate a pedestrian cycle in response to a signal provided by a second actuator.

6. The traffic signal of claim 1, wherein the micro-controller is configured to execute a process that periodically inspects a memory location to determine whether to initiate a pedestrian cycle.

7. The traffic signal of claim 1, wherein the micro-controller is configured to execute a selected pedestrian cycle in response to a signal from one of the first and second actuators, the pedestrian cycle being selected on the basis of which of the first and second actuators provides the signal.

8. The traffic signal of claim 7, wherein the selected pedestrian cycles have different intervals of different lengths, the intervals being selected from the group consisting of a walk interval, a wait interval and a sprint interval.

9. A method for controlling a traffic signal, the method comprising:

controlling the traffic signal in accord with a first cycle;

detecting an interrupt signal on one of a plurality of pedestrian-actuated input terminals;

interrupting the first cycle; and executing a selected second cycle in place of the first cycle, the second cycle being selected on the basis of which of the pedestrian-actuated input terminals carried the interrupt signal.

10. The method of claim 9, wherein detecting an interrupt signal comprises detecting a wireless signal.

11. The method of claim 9, wherein interrupting the first cycle comprises executing an immediate interrupt of the first cycle.

12. The method of claim 9, wherein interrupting the first cycle comprises setting an interrupt indicator and periodically inspecting the interrupt indicator to determine whether to interrupt the first cycle.

13. The method of claim 9, further comprising selecting the first cycle to be a vehicular cycle and selecting the second cycle to be a pedestrian cycle.

14. The method of claim 13, further comprising selecting the second cycle to be one of a first pedestrian cycle having a first walk interval and a second pedestrian cycle having a second walk interval that is longer than the first walk interval.

15. A computer-readable medium having encoded thereon software for controlling a traffic signal, the software comprising instructions for:

controlling the traffic signal in accord with a first cycle;

detecting an interrupt signal on one of a plurality of pedestrian-actuated input terminals;

interrupting the first cycle; and executing a selected second cycle in place of the first cycle, the second cycle being selected on the basis of which of the pedestrian-actuated input terminals carried the interrupt signal.

16. The computer-readable medium of claim 15, wherein the instructions for detecting an interrupt signal comprise instructions for detecting a wireless signal.

17. The computer-readable medium of claim 15, wherein the instructions for interrupting the first cycle comprise instructions for executing an immediate interrupt of the first cycle.

18. The computer-readable medium of claim 15, wherein the instructions for interrupting the first cycle comprise instructions for setting an interrupt indicator and instructions for periodically inspecting the interrupt indicator to determine whether to interrupt the first cycle.

19. The computer-readable medium of claim 15, wherein the software further comprises instructions for selecting the first cycle to be a vehicular cycle and selecting the second cycle to be a pedestrian cycle.

20. The computer-readable medium of claim 15, wherein the instructions further comprise instructions for selecting the second cycle to be one of a first pedestrian cycle having a first walk interval and a second pedestrian cycle having a second walk interval that is longer than the first walk interval.

* * * * *